US011268350B2

(12) United States Patent
Garcia

(10) Patent No.: US 11,268,350 B2
(45) Date of Patent: Mar. 8, 2022

(54) INTELLIGENT ENERGY MANAGEMENT SYSTEM OF A DRILLING RIG

(71) Applicant: Schlumberger Technology Corporation, Sugar Land, TX (US)

(72) Inventor: Mateo Garcia, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 123 days.

(21) Appl. No.: 16/839,794

(22) Filed: Apr. 3, 2020

(65) Prior Publication Data

US 2021/0310337 A1 Oct. 7, 2021

(51) Int. Cl.

*E21B 41/00* (2006.01)
*E21B 44/04* (2006.01)
*E21B 4/04* (2006.01)

(52) U.S. Cl.

CPC ..... *E21B 41/0085* (2013.01); *E21B 44/04* (2013.01); *E21B 4/04* (2013.01)

(58) Field of Classification Search

CPC ..... E21B 41/0085
See application file for complete search history.

(56) References Cited

U.S. PATENT DOCUMENTS 6,639,331 B2 10/2003 Schultz
8,519,565 B2 8/2013 Dozier et al.
8,604,639 B2 12/2013 Hopwood
9,240,687 B2 1/2016 Carralero et al.
9,644,431 B2 5/2017 Myers et al.
9,803,461 B2 10/2017 Boone
9,806,530 B2 10/2017 Martinez
9,856,719 B1 * 1/2018 Williams ..... H02J 3/28
10,017,993 B2 7/2018 Hu et al.
10,151,178 B2 12/2018 Stephenson et al.
10,243,371 B2 3/2019 Gerdes et al.
10,309,166 B2 6/2019 Thiemann et al.
10,390,466 B2 8/2019 Held et al.
10,472,953 B2 11/2019 Orban
10,491,004 B2 11/2019 Gerdes et al.
10,597,996 B2 3/2020 Boone
10,649,427 B2 5/2020 Krippner et al.
10,655,292 B2 5/2020 Orban
10,662,709 B2 5/2020 Orban
10,673,238 B2 6/2020 Boone et al.
(Continued)

FOREIGN PATENT DOCUMENTS

WO 2018201118 A1 11/2018
WO 2018213925 A1 11/2018
(Continued)

*Primary Examiner* — Giovanna Wright

(57) ABSTRACT

A system may include a top drive coupled to a mast on a drilling rig. Additionally, a common bus may be coupled to the top drive. A drawworks may be coupled to the common bus and the top drive, and the drawworks lowers and raises the top drive throughout the mast. A generator may be coupled to the common bus, and the generator transmits electric power to the drawworks. Further, a controller may be coupled to the top drive, common bus, the generator, and the drawworks. The common bus may transmit the electric power between the top drive, drawworks, and the generator. The controller may manage a transmission of stored power in the top drive to the drawworks.

19 Claims, 7 Drawing Sheets

(56) References Cited

U.S. PATENT DOCUMENTS

| | | | | |
|---|---|---|---|---|
| 10,697,275 | B2 | 6/2020 | Krippner et al. | |
| 10,699,822 | B2 | 6/2020 | Orban et al. | |
| 10,724,341 | B2 | 7/2020 | Krippner et al. | |
| 10,745,975 | B2 | 8/2020 | Orban et al. | |
| 2013/0307444 | A1* | 11/2013 | Settemsdal | H02J 4/00 318/139 |
| 2014/0077600 | A1* | 3/2014 | Cryer | E21B 41/00 307/48 |
| 2017/0211338 | A1 | 7/2017 | Myers et al. | |
| 2019/0048667 | A1 | 2/2019 | Krippner et al. | |
| 2019/0115758 | A1 | 4/2019 | Orban et al. | |
| 2019/0128107 | A1 | 5/2019 | Janakiraman et al. | |
| 2019/0131905 | A1 | 5/2019 | Janakiraman et al. | |
| 2019/0267805 | A1 | 8/2019 | Kothuru et al. | |

FOREIGN PATENT DOCUMENTS

| | | | |
|---|---|---|---|
| WO | 2019084530 | A1 | 5/2019 |
| WO | 2019118352 | A1 | 6/2019 |
| WO | 2019118477 | A1 | 6/2019 |
| WO | 2019232515 | A1 | 12/2019 |

* cited by examiner

INTELLIGENT ENERGY MANAGEMENT SYSTEM OF A DRILLING RIG

BACKGROUND

Various network devices, electric power generators and motors may be disposed throughout a drilling rig in order to control various operations on the drilling rig. These network devices may control drilling equipment, monitor the performance of the drilling rig, and/or perform various maintenance operations with respect to the drilling rig. In particular, these network devices may include sensors that collect sensor measurements, system requirement, and fuel requirement around the drilling rig. Accordingly, various problems may exist in regard to effective utilization of energy management system based on sensor data between different network devices and electric power generators on the drilling rig.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, the embodiments disclosed herein relate to a system that may include a top drive coupled to a mast on a drilling rig. Additionally, a common bus may be coupled to the top drive. A drawworks may be coupled to the common bus and the top drive, and the drawworks lowers and raises the top drive throughout the mast. A generator may be coupled to the common bus, and the generator transmits electric power to the drawworks. Further, a controller may be coupled to the top drive, common bus, the generator, and the drawworks. The common bus may transmit the electric power between the top drive, drawworks, and the generator. The controller may manage a transmission of stored power in the top drive to the drawworks.

In another aspect, the embodiments disclosed herein relate to a method. The method may include obtaining, by a controller, power measurements regarding operation of a top drive; determining, by the controller and using the power measurements, an amount of stored power in the top drive; determining, by the controller and based on the amount of stored power an amount of electric power from a generator for operating a drawworks; and transmitting, using the controller and over a common bus coupled to the top drive and a drawworks, the amount of electric power and at least a portion of the amount of stored power to the drawworks.

In yet another aspect, the embodiments disclosed herein relate to a non-transitory computer readable medium storing instructions on a memory coupled to a processor. The instructions may include functionality for: obtaining power measurements regarding operation of a top drive; determining, using the power measurements, an amount of stored power in the top drive; determining, using the amount of stored power, an amount of electric power from a generator for operating a drawworks; and transmitting, over a common bus coupled to the top drive and a drawworks, the amount of electric power and a portion of the amount of stored power to the drawworks.

Other aspects of the disclosure will be apparent from the following description and the appended claims.

DETAILED DESCRIPTION

Figure 1:
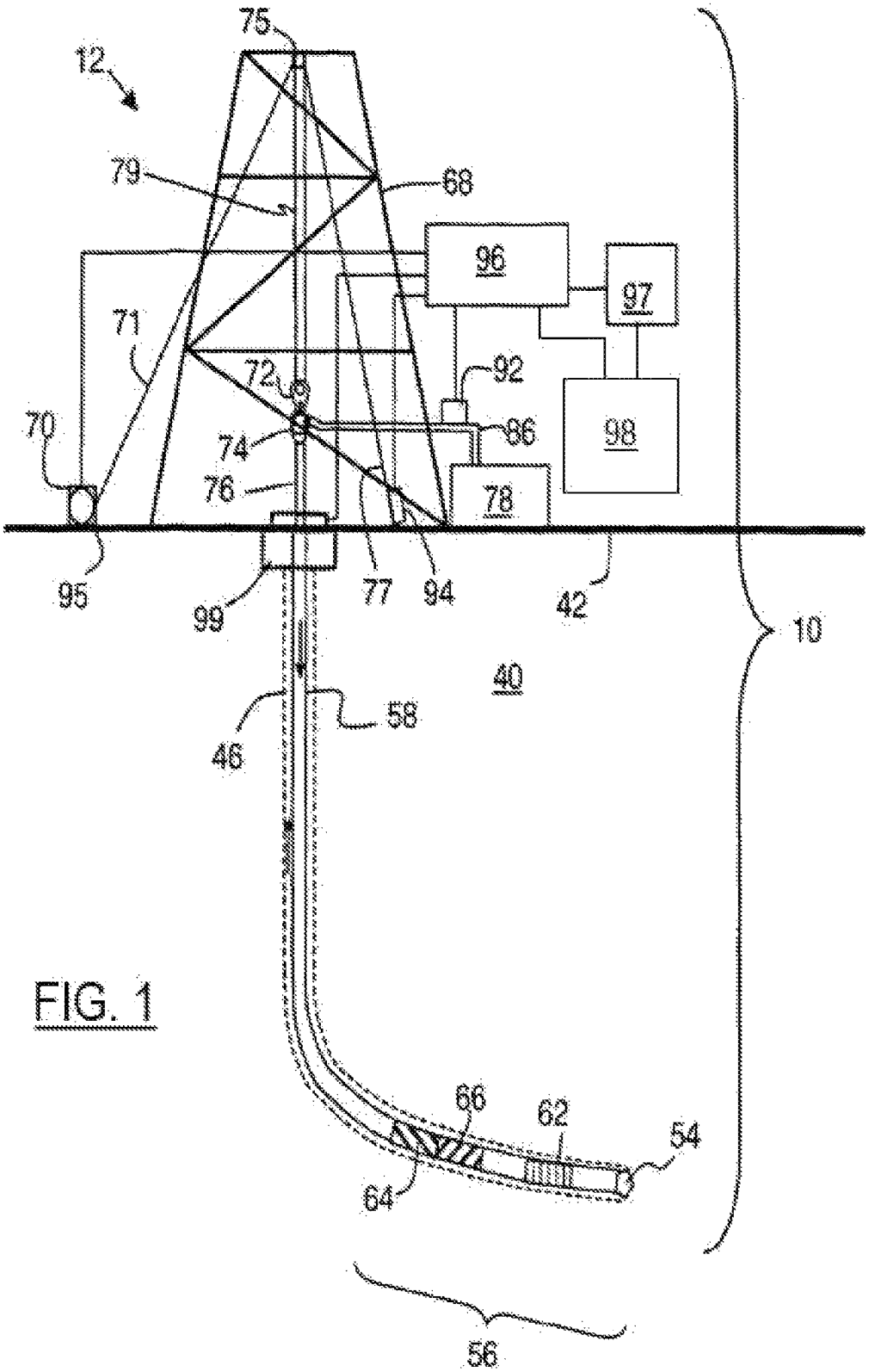
FIGS. 1 and 2 show systems in accordance with one or more embodiments.

Specific embodiments of the disclosure will now be described in detail with reference to the accompanying figures. Like elements in the various figures are denoted by like reference numerals for consistency.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include a system and various methods for managing energy consumption throughout a drilling rig system. Specifically, the system may implement an automated process for managing transient loads and power spikes by transmitting electric power between drilling rig equipment (e.g., a top drive, drawworks, and a generator). In particular, this electric power management is orchestrated by a controller coupled to a common bus. In a non-limiting example, the common bus may be in communication with a controller such that the controller may manage a transmission of stored power from one piece of drilling rig equipment (e.g., top drive) to another piece of drilling rig equipment (e.g., drawworks) based on energy consumption requirements. Accordingly, the common bus may regulate peak power requirements in the common bus as well as peak power requirements of drilling equipment coupled to the common bus.

Furthermore, the controller, through the common bus, may obtain a power consumption of a top drive on the drilling rig using current power consumption, transient loads, various equipment operation states and downhole information in real time and parameters obtained from a sensor system. In addition, the controller may obtain information and/or data to determine an amount of stored power in the top drive to use in conjunction or separate with an electric power from a generator for operating a drawworks. In a non-limiting example, as the top drive is lowered by the drawworks, energy is being dissipated via heat from dynamic brake resistors. Additionally, when the top drive is raised with the drawworks, power is required from the generators to start lifting the top drive. Although power is required to lift the top drive at steady state, power is also used to accelerate the drawworks to full speed prior to reaching full speed. Full power is achieved when full speed and full acceleration is happening and once steady state speed is reached, the power significantly reduces. Thus, by using the controller through the common bus, energy that is being removed from the drawworks as the top drive is lowered may be reclaimed. One skilled in the art will appreciate, upon reading this disclosure, how reclaiming this lost energy may then be used to speed up the top drive rotation to full speed and be used as a temporary energy storage. Further, the controller through the common bus may use the stored energy in the top drive to aid in accelerating the drawworks to raise the top drive and minimize a peak power requirements from the generators.

FIG. 1 shows a block diagram of a system in accordance with one or more embodiments. FIG. 1 shows a drilling system (10) according to one or more embodiments. Drill string (58) is shown within borehole (46). Borehole (46) may be located in the earth (40) having a surface (42). Borehole (46) is shown being cut by the action of drill bit (54). Drill bit (54) may be disposed at the far end of the bottom hole assembly (56) that is attached to and forms the lower portion of drill string (58). Bottom hole assembly (56) may include a number of devices including various subassemblies. Measurement-while-drilling (MWD) and/or logging-while-drilling (LWD) subassemblies may be included in subassemblies (62). Examples of MWD measurements may include direction, inclination, survey data, downhole pressure (inside the drill pipe, and/or outside and/or annular pressure), resistivity, density, and porosity. Subassemblies (62) may also include a subassembly for measuring torque and weight on the drill bit (54). The signals from the subassemblies (62) may be processed in a processor (66). After processing, the information from processor (66) may be communicated to pulser assembly (64). Pulser assembly (64) may convert the information from the processor (66) into pressure pulses in the drilling fluid. The pressure pulses may be generated in a particular pattern which represents the data from the subassemblies (62). The pressure pulses may travel upwards through the drilling fluid in the central opening in the drill string and towards the surface system. The subassemblies in the bottom hole assembly (56) may further include a turbine or motor for providing power for rotating and steering drill bit (54). Alternatively, the signals from subassembly (62) may be transmitted to the surface via other telemetry means, such as EM telemetry, or wired drillpipe, etc.

The drilling rig (12) may include a derrick (68) and hoisting system, a rotating system, and/or a mud circulation system, for example. The hoisting system may suspend the drill string (58) and may include draw works (70), fast line (71), crown block (75), drilling line (79), traveling block and hook (72), and/or deadline (77). A rotating system may include a top drive (74) and/or engines (not shown). The rotating system may impart a rotational force on the drill string (58).

In one or more embodiments, the top drive (74) may be electric and may be connected to a short section of pipe called a quill (76), that in turn may be screwed into a saver sub or the drill string (58) itself. Additionally, the top drive (74) may be suspended from the hook (72), such that the rotary mechanism is free to travel up and down a mast of the derrick (68). It is further envisioned that a flywheel may be incorporated into the top drive (74). In a non-limiting example, a flywheel may be a mechanical device for storing rotational energy. Additionally, flywheels resist changes in rotational speed by their moment of inertia. The amount of energy stored in the flywheel is proportional to the rotational speed and a mass of the flywheel. One skilled in the art will appreciate how the flywheels may act as mechanical energy storage devices to be a kinetic-energy-storage analogue and accumulator for the engines of the top drive (74). In addition, with the flywheel being an accumulator, the flywheel may also act as a low-pass filter on an angular velocity of the top drive (74). Advantageously, the top drive (74) acting as a flywheel may provide smooth power output from an energy source (i.e., the engines), storage for energy to be used at another time, extra energy at rates beyond the capacity of the energy source, a continuous energy source, and may control an orientation of a rotation of the top drive (74). Although the drilling system (10) is shown being on land, those of skill in the art will recognize that the described embodiments are equally applicable to marine environments as well.

The mud circulation system may pump drilling fluid down an opening in the drill string. The drilling fluid may be called mud, which may be a mixture of water and/or diesel fuel, special clays, and/or other chemicals. The mud may be stored in mud pit (78). The mud may be drawn into mud pumps (not shown), which may pump the mud though stand pipe (86) and into the top drive (74), which may include a rotating seal. Likewise, the described technologies may also be applicable to underbalanced drilling. If underbalanced drilling is used, at some point prior to entering the drill string, gas may be introduced into the mud using an injection system (not shown).

The mud may pass through drill string (58) and through drill bit (54). As the cutting elements of the drill bit (54) grind and gouge the earth formation into cuttings, the mud may be ejected out of openings or nozzles in the drill bit (54). These jets of mud may lift the cuttings off the bottom of the hole and away from the drill bit (54), and up towards the surface in the annular space between drill string (58) and the wall of borehole (46).

At the surface, the mud and cuttings may leave the well through a side outlet at bellnipper (not shown) above blowout preventer (99) and through mud return line (not shown). Blowout preventer (99) comprises a pressure control device and associated seal. The mud return line may feed the mud into one or more separator (not shown) which may separate the mud from the cuttings. From the separator, the mud may be returned to mud pit (78) for storage and re-use.

Various sensor devices may be placed on the drilling rig (12) to take measurements of the drilling equipment, the well parameters as well as formation properties. In particular, a hookload may be measured by hookload sensor (94) mounted on deadline (77), block position and the related block velocity may be measured by a block sensor (95) which may be part of the draw works (70). Surface torque may be measured by a sensor device on the top drive (74) or the rotary table (88). In another embodiment, surface torque may be measured through instrumentation on or below the top drive (74), or through measuring top drive current. Standpipe pressure may be measured by pressure sensor (92), located on standpipe (86). Signals from these measurements may be communicated to a surface processor (96) or other network elements (not shown) disposed around the drilling rig (12). In addition, mud pulses traveling up the drillstring may be detected by pressure sensor (92). For example, pressure sensor (92) may include a transducer that converts the mud pressure into electronic signals. The pressure sensor (92) may be connected to surface processor (96) that converts the signal from the pressure signal into digital form, stores and demodulates the digital signal into useable MWD data. According to various embodiments described above, surface processor (96) may be programmed to automatically detect one or more rig states based on the various input channels described. Surface processor (96) may be programmed, for example, to carry out an automated event detection as described above. Surface processor (96) may transmit a particular rig state and/or event detection information to user interface system (97) which may be designed to warn various drilling personnel of events occurring on the rig and/or suggest activity to the drilling personnel to avoid specific events. All of the above described components of a drilling rig system consume power, and embodiments of the present disclosure relate to a system and method for intelligently managing the power requirements for these and other rig equipment.

Figure 2:
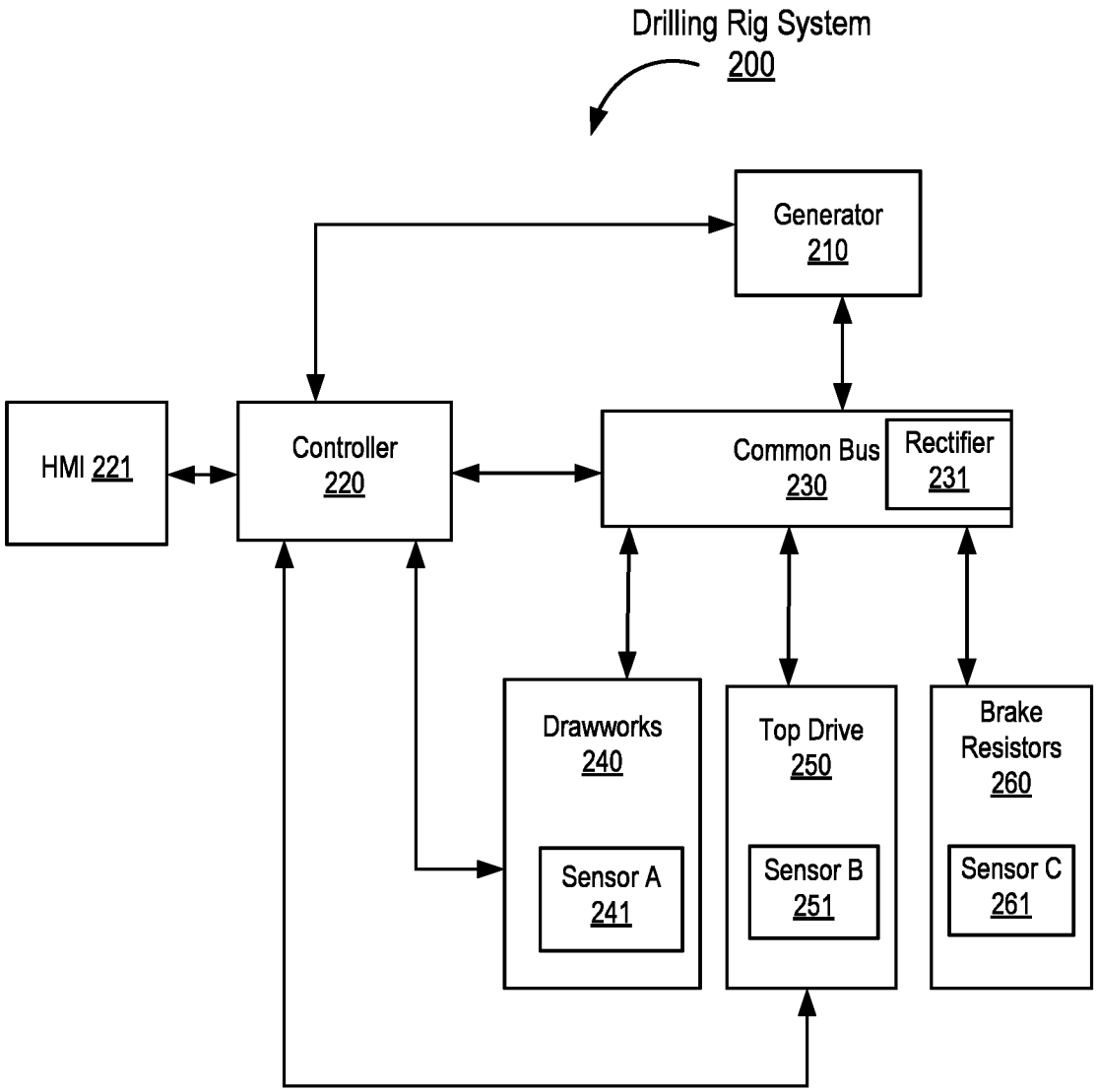

Turning to FIG. 2, FIG. 2 shows a block diagram of a system in accordance with one or more embodiments. As shown in FIG. 2, a drilling rig system (200) may include various generators (e.g., generator (210)), a controller (e.g., controller (220)) coupled with a human machine interface (HMI) (e.g., HMI (221)), common bus (e.g., common bus (230)), and various rig equipment (e.g., drawworks (240), top drive (250), and brake resistors (206)). Additionally, the rig equipment (e.g., drawworks (240), top drive (250), and brake resistors (206)) may be coupled to various sensors (e.g., sensor A (241), sensor B (251), sensor C (261)).

In one or more embodiments, the controller (e.g., controller (220)) may be hardware and/or software that includes functionality to manage an energy transfer between the top drive (250) and various components (e.g., the drawworks (240)). For example, the controller (220) may be a variable frequency drive (VFD) coupled to the common bus (230) to control the power consumption and energy storage of the top drive (250) from the rig equipment, such as the drawworks (240), the generator (210), and the brake resistors. The controller (220) may varying a frequency and voltage supplied to the drawworks (240). Specifically, the controller (220) may control the use and transmission of electric power from a generator to power the drawworks (240) such that the top drive (250) may move up and down a mast of a drilling rig. Additionally, the controller (220) may determine and control an amount of stored energy in the top drive (250) that is transmitted to the drawworks (240). Likewise, the controller (220) may also control warning alarms and/or pressure releases within the top drive (250). It is further envisioned that the controller (220) may be a ruggedized computer system with functionality to withstand vibrations, extreme temperatures, wet conditions, and/or dusty conditions, for example, around a drilling rig.

Moreover, the controller (220) may be coupled to various control systems that include multiple PLCs within the drilling rig system (200). For example, a control system may include functionality to control operations within a system, assembly, and/or subassembly described above in FIG. 1 and the accompanying description. As such, one or more of the drilling rig system (200) may include functionality to monitor and/or perform various drilling processes performed by various operations with respect to the mud circulation system, the rotating system, the hoisting system, a pipe handling system, and/or various other drilling activities described with respect to FIG. 1 and the accompanying description. Without loss of generality, the term "control system" may refer to a drilling operation control system that is used to operate and control the equipment, a drilling data acquisition and monitoring system that is used to acquire drilling process and equipment data and to monitor the operation of the drilling process, or a drilling interpretation software system that is used to analyze and understand drilling events and progress.

In one or more embodiments, the controller (220) may be coupled to the common bus (230) to communicate and control power usage of the top drive (250). For example, the controller (220) may be a centralized processing device that includes hardware and/or software at or near the common bus (230). For example, the controller (220) may include functionality for managing an amount of power obtained from the generators to power the top drive via drawworks. The controller (220) may transmit various generator commands and/or motor commands to coordinate the power supply to the top drive from the generators. It is further envisioned that the controller (220) may manage the timings of the start and stop of the generators to reduce sudden transient power spike and optimize power consumption of the top drive. Likewise, the controller (220) may obtain sensor data from various devices, e.g., sensors (241, 251, 261) and various control systems on the drilling rig system (200). Moreover, the controller (220) may include a computer processor similar to the computer processor (502) described below in FIG. 5A and the accompanying description.

In some embodiments, the common bus (230) may include a rectifier (e.g., rectifier (231)). For example, the rectifier (231) may be an electrical device which converts an alternating current (AC) into a direct current (DC) by allowing a current to flow through the rectifier (231) in one direction only. The rectifier (231) may send a DC power from a power source to power the rig equipment (e.g., drawworks (240), the top drive (250), and the resistor (260)).

Moreover, the generators (e.g., generator (210)) of the drilling rig system (200) may include hardware and/or software for converting fuel into electric energy for operating the rig equipment. For example, the generators (e.g., generator (210)) may be an electric motor such as the electric motors (234). The electric motors (234) may be a continuous-duty universal motors, brushless DC motors, and/or synchronous single phase AC motors. It is further envisioned that the common bus (230) may include a rectifier to convert DC power to generate DC and AC power for the drawworks (240). Furthermore, the rig system (200) may further include a fuel supply for the various generators (e.g., generator (210)). A fuel supply may include hardware and/or software that includes functionality for monitoring the amount of fuel stored in the fuel supply. In one or more embodiments, the fuel supply is a moveable container that includes functionality for distributing fuel to various devices around a drilling rig and/or drilling management network. In one or more embodiments, the generators (e.g., generator (210)) may be a diesel engine-generator. Further, the fuel supply may send fuel to the generators (e.g., generator (210)) which transmit electricity to run the drawworks (240).

In one or more embodiments, the HMI (221) may be hardware and/or software coupled to the controller (220). In a non-limiting example, the HMI (221) may allow the operator to interact with the drilling system, e.g., to send commands to the controller (220) to manage power transfers over the common bus (230), or to view sensor information from the rig equipment (e.g., drawworks (240), top drive (250), and brake resistors (206)). Further, the HMI (221) may include functionality for presenting data and/or receiving inputs from a user regarding various drilling operations. In a non-limiting example, the HMI (221) may be a user device such as personal computers, smartphones, and any other devices coupled to a network that obtain inputs from one or more users, e.g., by providing a graphical user interface (GUI) for presenting data and/or receiving control commands for operating the rig equipment (e.g., drawworks (240), top drive (250), and brake resistors (206)).

Still referring to FIG. 2, in one or more embodiments, the brake resistors (206) may include a dynamic brake resistor that dissipates energy as the top drive is being decelerated. For example, the brake resistors (206) may be coupled to the top drive (250) or the drawworks (240) such that when the top drive (250) or the drawworks (240) produce heat, the brake resistors (206) dissipate the produced heat.

In some embodiments, rig equipment (e.g., the generator (210), controller (220), drawworks (240), top drive (250), and brake resistors (206), etc.) transmitting data may be a network element coupled to the HMI (221). The network element may refer to various hardware components within a network, including switches, routers, hubs or any other logical entities for uniting one or more physical devices on the network. In particular, a network element, the HMI (221), and/or the common bus (230) may be a computing system similar to the computing system (500) described in FIGS. 5A and 5B, and the accompanying description.

The sensors (e.g., sensor A (241), sensor B (251), sensor C (261)) may include hardware and/or software that includes functionality to obtain one or more sensor measurements, e.g., a sensor measurement of an environment condition proximate the sensors. The sensors may process the sensor measurements into various types of sensor data. For example, the sensors may include functionality to convert sensor measurements obtained from sensor data into a communication protocol format for the controller through the common bus. The sensors may include pressure sensors, torque sensors, rotary switches, weight sensors, position sensors, microswitches, etc. The sensors may include smart sensors. In some embodiments, the sensors may include sensor circuitry without a communication interface or memory. For example, the sensors may be coupled with a computer device that transmits sensor data over a drilling management network.

In one or more embodiments, one or more devices and/or systems on the drilling rig system (200) may transmit power data packets, e.g., power consumption data, to the common bus (220) and/or receive data packets from the rig equipment (e.g., drawworks (240), the top drive (250), and the brake resistor (260)) regarding the power requirements and consumption. For example, power data may be sent over the common bus to the controller using a communication protocol. Power data may include measurements regarding operation of a top drive, an amount of stored power in the top drive, and the amount of stored power and an amount of electric power from a generator needed for operating a drawworks. Likewise, the power data may further include an estimation of a projected power consumption of the drilling rig based on a current power consumption, various equipment operation states and design parameters, number of electric power generators, generator and motor working conditions (on/off, ready or under or needing repair or maintenance, etc.), timing of the start and stop of various equipment to optimize drilling operation and so forth.

While FIGS. 1 and 2 show various configurations of components, other configurations may be used without departing from the scope of the disclosure. For example, various components in FIGS. 1 and 2 may be combined to create a single component. As another example, the functionality performed by a single component may be performed by two or more components.

Figure 3A:
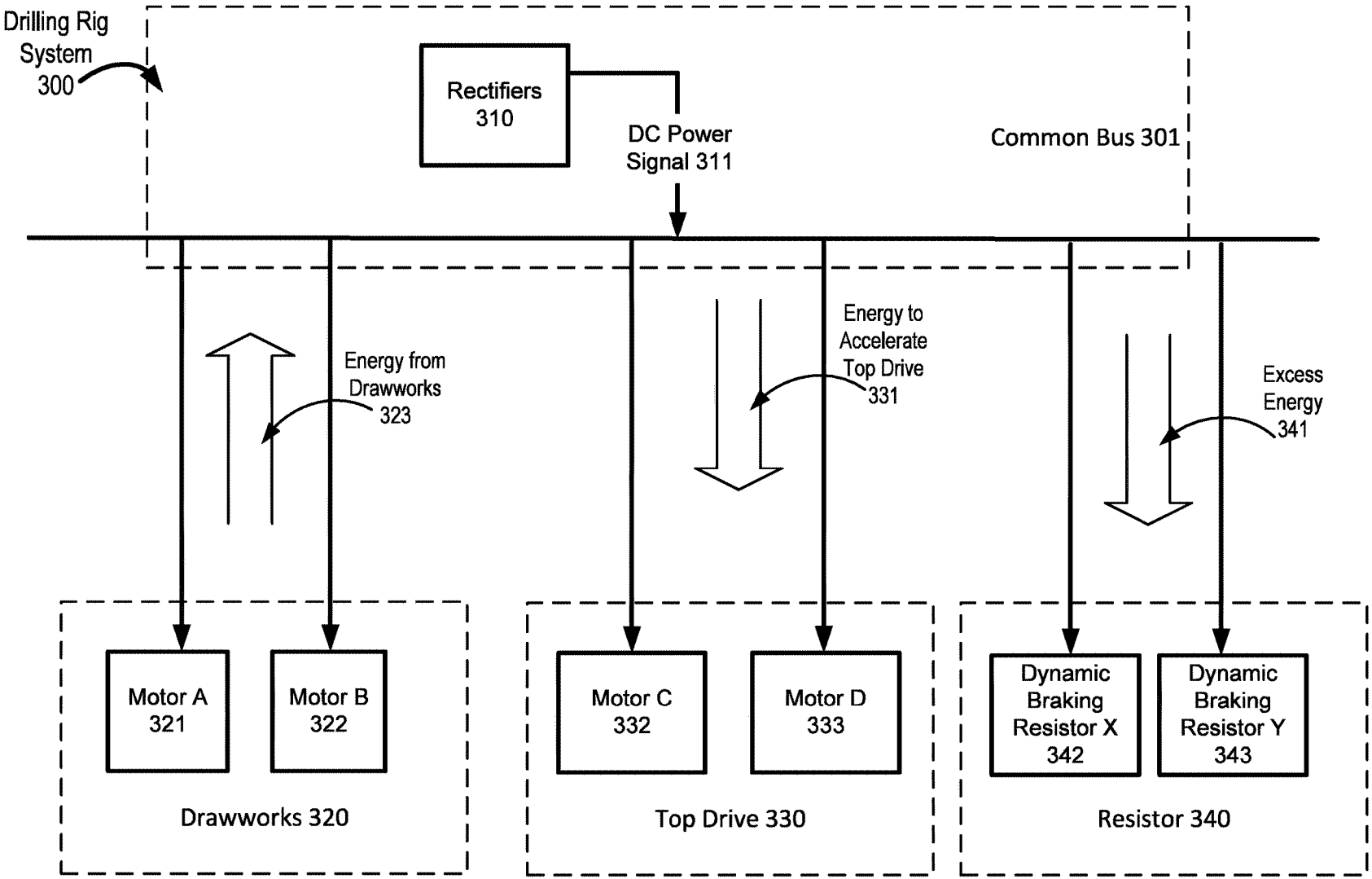
FIGS. 3A, 3B, and 3C show examples in accordance with one or more embodiments.
Figure 3B:
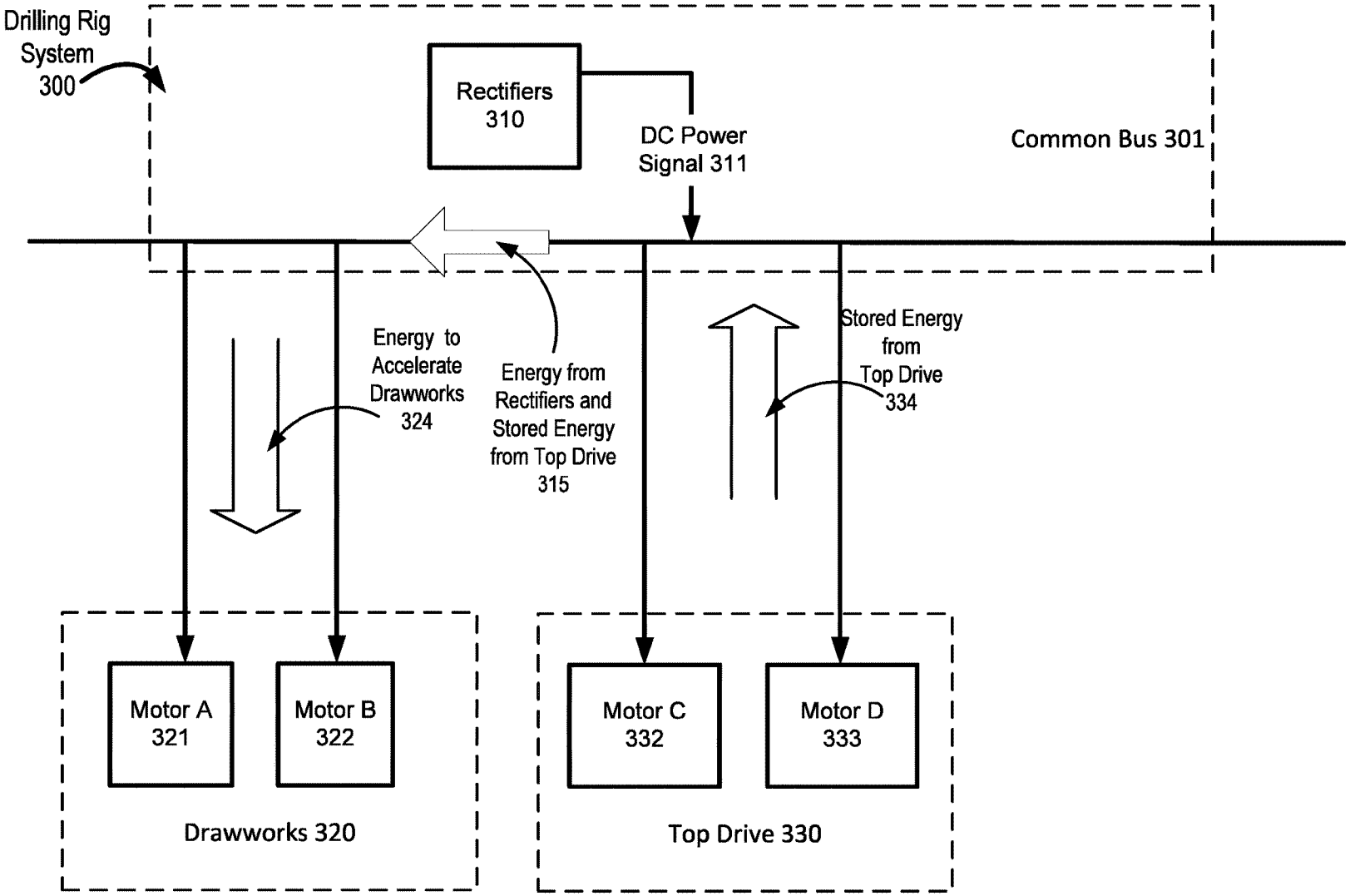
Figure 3C:
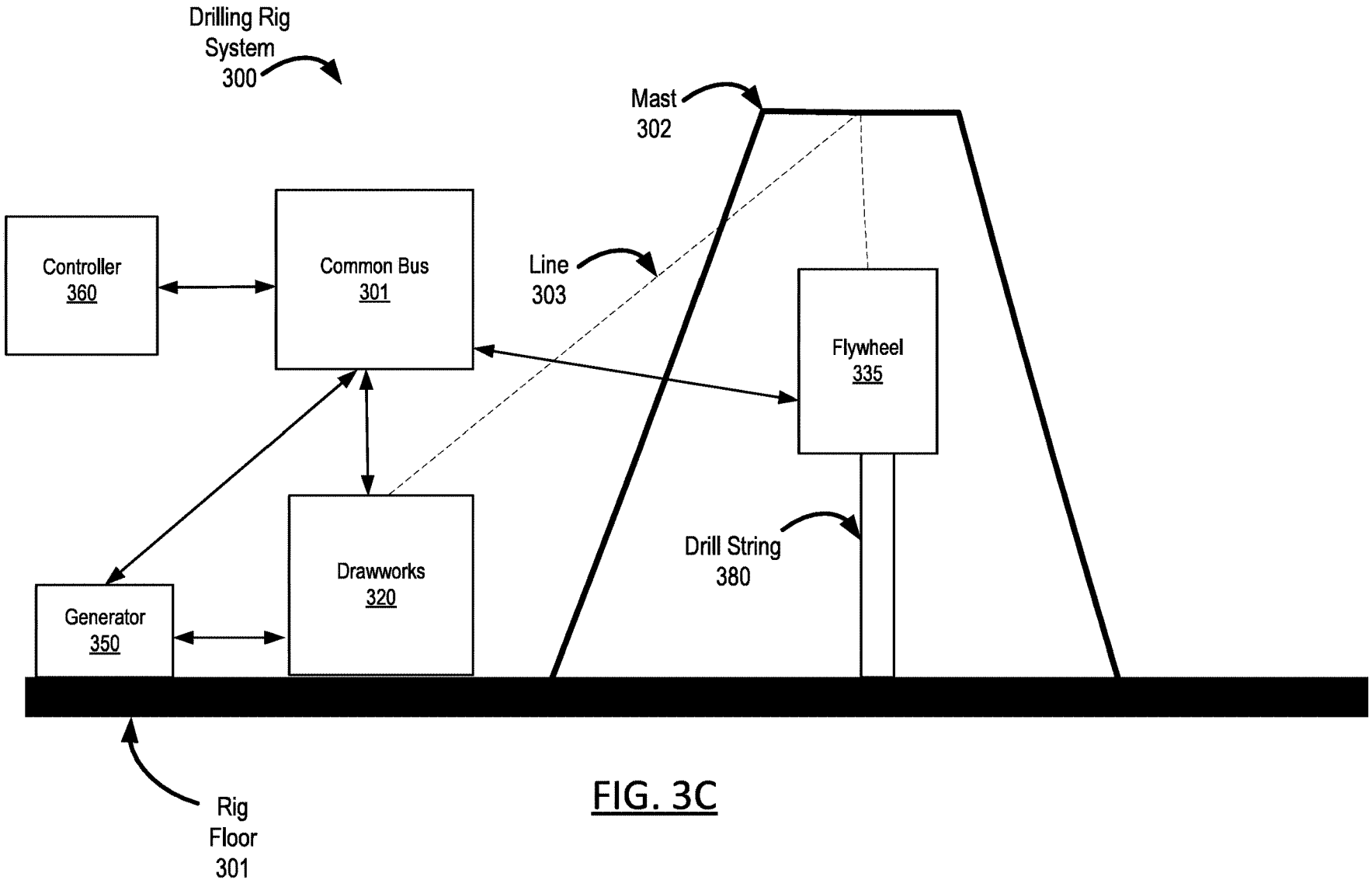

Turning to FIGS. 3A-3C, FIGS. 3A and 3B show examples of energy management over a common bus on a drilling rig exemplified in FIG. 3C in accordance with one or more embodiments. The following example is for explanatory purposes only and not intended to limit the scope of the invention. As shown in FIGS. 3A and 3B, a drilling rig system (300) may include various electrical devices (e.g., common bus (301) with rectifier (310)), various hoisting devices (e.g., drawworks (320)), various rotatory devices (e.g., top drive (330)), and various resistors (e.g., resistor (340)).

In one or more embodiments, the controller sends commands to the common bus (301) to power the rig equipment (e.g., drawworks (320), the top drive (330), and the resistor (340)) and one or more programmable logic controllers (PLCs). Specifically, over the common bus (301), the controller may command the rectifier (310) to send a DC power signal (311) from a power source to power the drawworks (320) for raising and lowering the top drive (330).

As shown in FIG. 3A, when the top drive (330) is being lowered, the rectifier (310) may send the DC power signal (311) to a motor A (321) and motor B (322) of the drawworks (320). With the DC power signal (311), the motor A (321) and motor B (322) of the drawworks (320) is powered to send an energy (323) from the drawworks (320) to operate the top drive (330). For example, the energy (323) is used as an energy to accelerate (331) the top drive (330). It is further envisioned that excess energy (341) from the top drive (330) is dissipated via a dynamic braking resistor X (342) and dynamic braking resistor Y (343) of the resistor (340). It is further envisioned that the DC power signal (311) from the rectifier (310) along with energy to accelerate (331) the top drive (330) is used in conjunction to operate a motor C (332) and motor D (333) of the top drive (330).

As shown in FIG. 3B, when the top drive (330) is being raised, a stored energy (334) from the top drive (330) may be used to assist the rectifier (310) which receives energy from a generator (not shown in FIG. 3B, but discussed in detail in FIG. 3C). For example, the common bus (301) may send a command to have both the rectifier (310) send the DC power signal (311) and the stored energy (334) from the top drive (330) to a motor A (321) and motor B (322) of the drawworks (320). With a combined energy (315) from the rectifier (310) and the top drive (330), the motor A (321) and motor B (322) of the drawworks (320) may be accelerated to operate the top drive (330). For example, the combined energy (315) is used as an energy to accelerate (324) the drawworks (320). While FIGS. 3A and 3B show each of the drawworks (320) and the top drive (330) with two motors (321, 322, 332, 333), it is noted that this is for example purposes only and each of the drawworks (320) and the top drive (330) may have any number of motors without departing from the scope of the present disclosure.

Turning to FIG. 3C, FIG. 3C shows an example of drilling rig having the common bus (301) used in the energy management examples of FIGS. 3A and 3B in accordance with one or more embodiments. The following example is for explanatory purposes only and not intended to limit the scope of the invention. FIG. 3C illustrates various electrical devices (e.g., a controller (360), a common bus (301), and a generator (350)), a drawworks (320) with one or more sensors, a mast (302), and a line (303), various rotatory devices (e.g., flywheel (335)) with a drill string 380 attached thereof. In addition, the common bus (370) may be coupled to the generator (350), drawworks (320), and flywheel (335) via a hard line or be wirelessly connected by using a centralized network. In one or more embodiments, the drawworks (320) may rest on the rig floor (301) and have the line (303) attached to a top of the mast (302). In addition, the drawworks (320) may be coupled to the flywheel (335) via the line (303) such that the drawworks (320) lowers and raises the flywheel (335) throughout the mast (302). The one or more sensors of the drawworks (320) may collect and store data to transmit to the common bus (370). Further, the flywheel (335) is coupled to the mast (302) via the line (303) of the drawworks (320) to make-up or break-up various joints of pipe making up the drill string (380) and various other downhole equipment.

In one or more embodiments, the generator (350) transmits electric power to the drawworks (320) through commands from the controller (360) via the common bus (301). With commands from the controller (360), the common bus (301) converts DC power to generate DC and AC power for the drawworks (320). When the drawworks (320) receives power from the generator (350), the drawworks (320) may accelerate the line (303) in a direction to raise or lower the flywheel (335) up the mast (303).

Still referring to FIG. 3C, the flywheel (335) stores rotational energy generated from and collected when the flywheel (335) is being lowered via the line (303). In addition, power measurements of the flywheel (335) may be take such that the controller (360) determines an amount of electric power from the generator (350) for operating the drawworks (320). Furthermore, the controller (360) transmits, over the common bus (301), the amount of electric power and a portion of the amount of stored power to the drawworks (320) to then operate the top drive (330). It is further envisioned that the controller (360), over the common bus (370), minimizes a peak power requirement of the generator (350) and the drawworks (320) during the raising of the flywheel (335).

Figure 4:
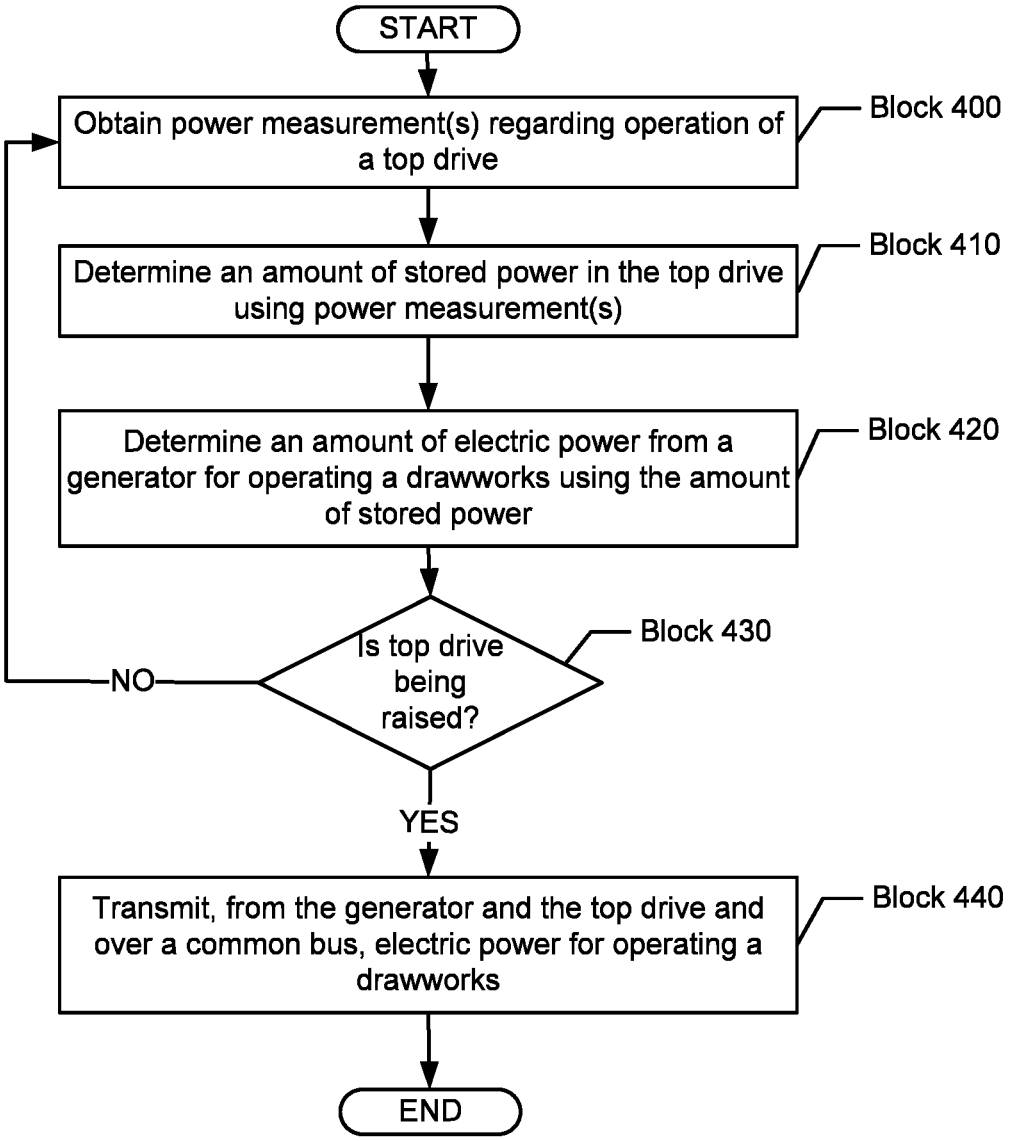
FIG. 4 shows a flowchart in accordance with one or more embodiments.

Turning to FIG. 4, FIG. 4 shows a flowchart in accordance with one or more embodiments. Specifically, FIG. 4 describes a general method for managing power across a common bus. One or more blocks in FIG. 4 may be performed by one or more components (e.g., controller (220)) as described in FIGS. 1-3C. While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 400, one or more power measurements for operating a top drive are obtained in accordance with one or more embodiments. For example, a controller may obtain power measurement data may be obtained from data packs which may include anticipated power demand and electric power readings in real time taken from sensor devices coupled to drilling equipment, e.g., a top drive. In particular, sensors on rig equipment have telemetry to transmit the data packs to the controller. Likewise, power measurement data may correspond to various parameter values, such as voltage levels, amounts of current, and quantities of power, e.g., in kilojoules. Moreover, the sensor devices may form a network connection, such as an Ethernet connection, with the controller for transmitting power measurement data over a drilling management network. In some embodiments, the power measurement data may be transmitted over the common bus. Moreover, the sensor device may be similar to the sensors described in FIG. 2 and the accompanying description.

In one embodiment, power measurement data may correspond to a top drive power capacity. For example, a top drive power capacity may be obtained based on available equipment configurations, such as the number of generators, the amount of fuel, and how fast one may be able to bring a new generator online, etc. The controller may obtain the top drive power capacity based on fuel data, e.g., an amount of fuel located in a fuel supply at a drilling rig. The fuel data may be used in conjunction with power measurement data to manage electric power over a drilling rig system.

In Block 410, an amount of stored power in a top drive is determined by using one or more power measurements in accordance with one or more embodiments. For example, the controller uses the one or more power measurements to calculate and determine the amount of stored power in the top drive. With the one or more power measurements, the controller is informed of the energy generated from lowering the top drive down a mast of a rig with the drawworks and rotating the top drive to generate rotational energy such that the flywheel will store the rotational energy. Likewise, during the lowering of the top drive, a portion of the stored energy is dissipated by brake resistors as heat.

In Block 420, an amount of electric power from a generator is determined for operating a drawworks using an amount of stored power in accordance with one or more embodiments. For example, the controller may determine how much power is needed for running the drawworks. In one or more embodiments, the controller manage a power consumption sequence defines a predetermined order of different amounts of electric power for use by the top drive. For example, the power consumption sequence may specify an amount of electric power obtained from an electric generator for use to power the drawworks. In one or more embodiments, the controller, using a software application, may configure the power consumption sequence to factor in using the stored power in conjunction with the drawworks such that a peak power level of the electric generator powering the drawworks is minimized. Likewise the controller may determine the availability of actual power and fuel in the drilling rig, including, for example, the number of electric power generators and their equipment operation status (on/off, ready or under repair, etc.).

In Block 430, a determination is made whether a top drive is being raised in accordance with one or more embodiments. For example, a controller may obtain data over a drilling management network identifying movement of the top drive. If the answer to the top drive being raised is no (e.g., the top drive being stationary or being lowered), the controller will go back to the Block 400 to repeat the previously mentioned Blocks (400-430) or stay on stand-by. However, if the answer to the top drive being raised is yes, the controller processed to Block 440.

In the Block 440, electric power is transmitted for operating the drawworks from a generator and a top drive and over a common bus in accordance with one or more embodiments. For example, over the common bus, the controller sends a command to the generator to send electric power to the drawworks and operate the top drive. Based on different power requirements, the controller may transfer the stored rotational energy from the top drive to a motor in the drawworks via the common bus. In one or more embodiments, the controller may receive a selection of a peak power level from a user device such that the controller transmits at least one command to the generator or the top drive to implement the peak power level using the amount of electric power and the stored energy. For example, the peak power level is when the generator and/or drawworks is being used at a max capacity (e.g., torque and horsepower output at maximum limitation), which may cause failures or fatigue the rig equipment.

In one or more embodiments, the flowchart of FIG. 4 allows for the controller, over the common bus, to reclaim energy lost as the top drive is lowered in the form of stored energy in the top drive. With the stored energy, the controller, over the common bus, commands the drawworks to use the stored energy in raising the top drive. For example, the stored energy is used in the top drive inertia to help accelerate the drawworks when raising the top drive and minimize the peak power level from the generator. One skilled in the art will appreciate how utilizing the controller coupled to the common bus, the drilling rig system discloses herein allow for fast and simple transfer power to and from the top drive and the drawworks.

Figure 5A:
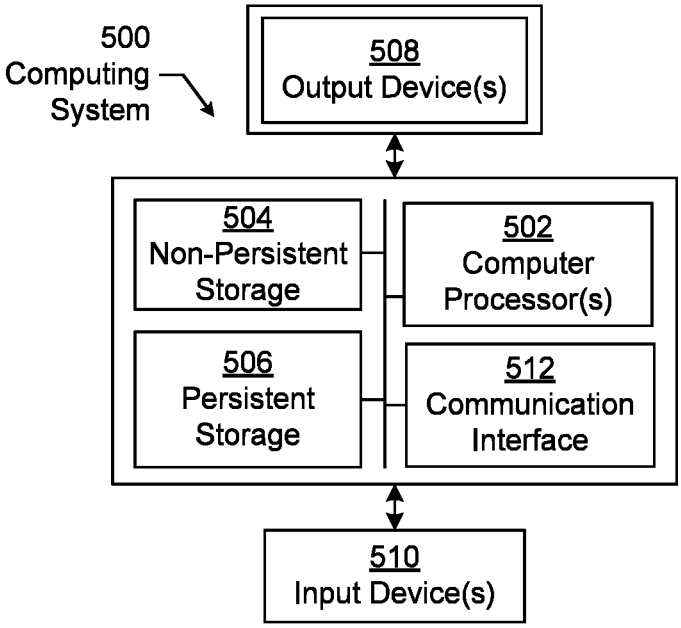
FIGS. 5A and 5B show a computing system in accordance with one or more embodiments.

Embodiments may be implemented on a computing system. Any combination of mobile, desktop, server, router, switch, embedded device, or other types of hardware may be used. For example, as shown in FIG. 5A, the computing system (500) may include one or more computer processors (502), non-persistent storage (504) (e.g., volatile memory, such as random access memory (RAM), cache memory), persistent storage (506) (e.g., a hard disk, an optical drive such as a compact disk (CD) drive or digital versatile disk (DVD) drive, a flash memory, etc.), a communication interface (512) (e.g., Bluetooth interface, infrared interface, network interface, optical interface, etc.), and numerous other elements and functionalities.

The computer processor(s) (502) may be an integrated circuit for processing instructions. For example, the computer processor(s) may be one or more cores or micro-cores of a processor. The computing system (500) may also include one or more input devices (510), such as a touchscreen, keyboard, mouse, microphone, touchpad, electronic pen, or any other type of input device.

The communication interface (512) may include an integrated circuit for connecting the computing system (500) to a network (not shown) (e.g., a local area network (LAN), a wide area network (WAN) such as the Internet, mobile network, or any other type of network) and/or to another device, such as another computing device.

Further, the computing system (500) may include one or more output devices (508), such as a screen (e.g., a liquid crystal display (LCD), a plasma display, touchscreen, cathode ray tube (CRT) monitor, projector, or other display device), a printer, external storage, or any other output device. One or more of the output devices may be the same or different from the input device(s). The input and output device(s) may be locally or remotely connected to the computer processor(s) (502), non-persistent storage (504), and persistent storage (506). Many different types of computing systems exist, and the aforementioned input and output device(s) may take other forms.

Software instructions in the form of computer readable program code to perform embodiments of the disclosure may be stored, in whole or in part, temporarily or permanently, on a non-transitory computer readable medium such as a CD, DVD, storage device, a diskette, a tape, flash memory, physical memory, or any other computer readable storage medium. Specifically, the software instructions may correspond to computer readable program code that, when executed by a processor(s), is configured to perform one or more embodiments of the disclosure.

Figure 5B:
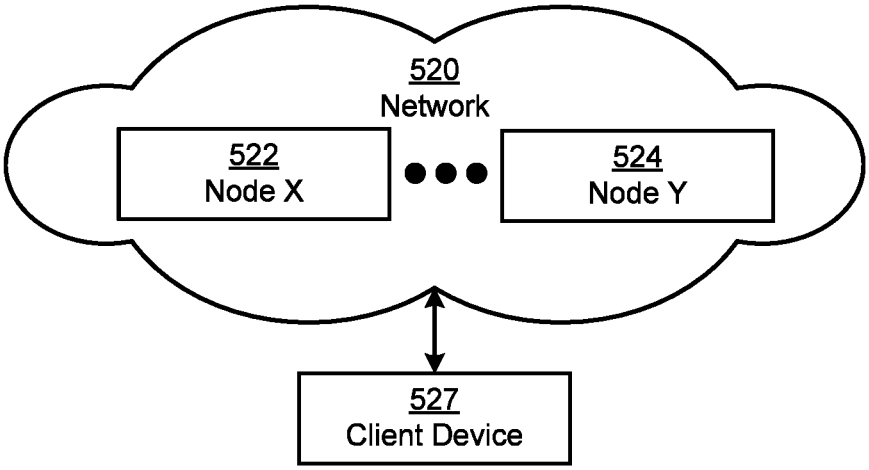

The computing system (500) in FIG. 5A may be connected to or be a part of a network. For example, as shown in FIG. 5B, the network (520) may include multiple nodes (e.g., node X (522), node Y (524)). Each node may correspond to a computing system, such as the computing system shown in FIG. 5A, or a group of nodes combined may correspond to the computing system shown in FIG. 5A. By way of an example, embodiments of the disclosure may be implemented on a node of a distributed system that is connected to other nodes. By way of another example, embodiments of the disclosure may be implemented on a distributed computing system having multiple nodes, where each portion of the disclosure may be located on a different node within the distributed computing system. Further, one or more elements of the aforementioned computing system (500) may be located at a remote location and connected to the other elements over a network.

Although not shown in FIG. 5B, the node may correspond to a blade in a server chassis that is connected to other nodes via a backplane. By way of another example, the node may correspond to a server in a data center. By way of another example, the node may correspond to a computer processor or micro-core of a computer processor with shared memory and/or resources.

The nodes (e.g., node X (522), node Y (524)) in the network (520) may be configured to provide services for a client device (526). For example, the nodes may be part of a cloud computing system. The nodes may include functionality to receive requests from the client device (526) and transmit responses to the client device (526). The client device (526) may be a computing system, such as the computing system shown in FIG. 5A. Further, the client device (526) may include and/or perform all or a portion of one or more embodiments of the disclosure.

The computing system or group of computing systems described in FIGS. 5A and 5B may include functionality to perform a variety of operations disclosed herein. For example, the computing system(s) may perform communication between processes on the same or different systems. A variety of mechanisms, employing some form of active or passive communication, may facilitate the exchange of data between processes on the same device. Examples representative of these inter-process communications include, but are not limited to, the implementation of a file, a signal, a socket, a message queue, a pipeline, a semaphore, shared memory, message passing, and a memory-mapped file. Further details pertaining to a couple of these non-limiting examples are provided below.

Based on the client-server networking model, sockets may serve as interfaces or communication channel endpoints enabling bidirectional data transfer between processes on the same device. Foremost, following the client-server networking model, a server process (e.g., a process that provides data) may create a first socket object. Next, the server process binds the first socket object, thereby associating the first socket object with a unique name and/or address. After creating and binding the first socket object, the server process then waits and listens for incoming connection requests from one or more client processes (e.g., processes that seek data). At this point, when a client process wishes to obtain data from a server process, the client process starts by creating a second socket object. The client process then proceeds to generate a connection request that includes at least the second socket object and the unique name and/or address associated with the first socket object. The client process then transmits the connection request to the server process. Depending on availability, the server process may accept the connection request, establishing a communication channel with the client process, or the server process, busy in handling other operations, may queue the connection request in a buffer until the server process is ready. An established connection informs the client process that communications may commence. In response, the client process may generate a data request specifying the data that the client process wishes to obtain. The data request is subsequently transmitted to the server process. Upon receiving the data request, the server process analyzes the request and gathers the requested data. Finally, the server process then generates a reply including at least the requested data and transmits the reply to the client process. The data may be transferred, more commonly, as datagrams or a stream of characters (e.g., bytes).

Shared memory refers to the allocation of virtual memory space in order to substantiate a mechanism for which data may be communicated and/or accessed by multiple processes. In implementing shared memory, an initializing process first creates a shareable segment in persistent or non-persistent storage. Post creation, the initializing process then mounts the shareable segment, subsequently mapping the shareable segment into the address space associated with the initializing process. Following the mounting, the initializing process proceeds to identify and grant access permission to one or more authorized processes that may also write and read data to and from the shareable segment. Changes made to the data in the shareable segment by one process may immediately affect other processes, which are also linked to the shareable segment. Further, when one of the authorized processes accesses the shareable segment, the shareable segment maps to the address space of that authorized process. Often, one authorized process may mount the shareable segment, other than the initializing process, at any given time.

Other techniques may be used to share data, such as the various data described in the present application, between processes without departing from the scope of the disclosure. The processes may be part of the same or different application and may execute on the same or different computing system.

Rather than or in addition to sharing data between processes, the computing system performing one or more embodiments of the disclosure may include functionality to receive data from a user. For example, in one or more embodiments, a user may submit data via a graphical user interface (GUI) on the user device. Data may be submitted via the graphical user interface by a user selecting one or more graphical user interface widgets or inserting text and other data into graphical user interface widgets using a touchpad, a keyboard, a mouse, or any other input device. In response to selecting a particular item, information regarding the particular item may be obtained from persistent or non-persistent storage by the computer processor. Upon selection of the item by the user, the contents of the obtained data regarding the particular item may be displayed on the user device in response to the user's selection.

By way of another example, a request to obtain data regarding the particular item may be sent to a server operatively connected to the user device through a network. For example, the user may select a uniform resource locator (URL) link within a web client of the user device, thereby initiating a Hypertext Transfer Protocol (HTTP) or other protocol request being sent to the network host associated with the URL. In response to the request, the server may extract the data regarding the particular selected item and send the data to the device that initiated the request. Once the user device has received the data regarding the particular item, the contents of the received data regarding the particular item may be displayed on the user device in response to the user's selection. Further to the above example, the data received from the server after selecting the URL link may provide a web page in Hyper Text Markup Language (HTML) that may be rendered by the web client and displayed on the user device.

Once data is obtained, such as by using techniques described above or from storage, the computing system, in performing one or more embodiments of the disclosure, may extract one or more data items from the obtained data. For example, the extraction may be performed as follows by the computing system (500) in FIG. 5A. First, the organizing pattern (e.g., grammar, schema, layout) of the data is determined, which may be based on one or more of the following: position (e.g., bit or column position, Nth token in a data stream, etc.), attribute (where the attribute is associated with one or more values), or a hierarchical/tree structure (consisting of layers of nodes at different levels of detail—such as in nested packet headers or nested document sections). Then, the raw, unprocessed stream of data symbols is parsed, in the context of the organizing pattern, into a stream (or layered structure) of tokens (where each token may have an associated token "type").

Next, extraction criteria are used to extract one or more data items from the token stream or structure, where the extraction criteria are processed according to the organizing pattern to extract one or more tokens (or nodes from a layered structure). For position-based data, the token(s) at the position(s) identified by the extraction criteria are extracted. For attribute/value-based data, the token(s) and/or node(s) associated with the attribute(s) satisfying the extraction criteria are extracted. For hierarchical/layered data, the token(s) associated with the node(s) matching the extraction criteria are extracted. The extraction criteria may be as simple as an identifier string or may be a query presented to a structured data repository (where the data repository may be organized according to a database schema or data format, such as XML).

The extracted data may be used for further processing by the computing system. For example, the computing system of FIG. 5A, while performing one or more embodiments of the disclosure, may perform data comparison. Data comparison may be used to compare two or more data values (e.g., A, B). For example, one or more embodiments may determine whether A>B, A=B, A !=B, A<B, etc. The comparison may be performed by submitting A, B, and an opcode specifying an operation related to the comparison into an arithmetic logic unit (ALU) (i.e., circuitry that performs arithmetic and/or bitwise logical operations on the two data values). The ALU outputs the numerical result of the operation and/or one or more status flags related to the numerical result. For example, the status flags may indicate whether the numerical result is a positive number, a negative number, zero, etc. By selecting the proper opcode and then reading the numerical results and/or status flags, the comparison may be executed. For example, in order to determine if A>B, B may be subtracted from A (i.e., A−B), and the status flags may be read to determine if the result is positive (i.e., if A>B, then A−B>0). In one or more embodiments, B may be considered a threshold, and A is deemed to satisfy the threshold if A=B or if A>B, as determined using the ALU. In one or more embodiments of the disclosure, A and B may be vectors, and comparing A with B includes comparing the first element of vector A with the first element of vector B, the second element of vector A with the second element of vector B, etc. In one or more embodiments, if A and B are strings, the binary values of the strings may be compared.

The computing system in FIG. 5A may implement and/or be connected to a data repository. For example, one type of data repository is a database. A database is a collection of information configured for ease of data retrieval, modification, re-organization, and deletion. Database Management System (DBMS) is a software application that provides an interface for users to define, create, query, update, or administer databases.

The user, or software application, may submit a statement or query into the DBMS. Then the DBMS interprets the statement. The statement may be a select statement to request information, update statement, create statement, delete statement, etc. Moreover, the statement may include parameters that specify data, or data container (database, table, record, column, view, etc.), identifier(s), conditions (comparison operators), functions (e.g. join, full join, count, average, etc.), sort (e.g. ascending, descending), or others. The DBMS may execute the statement. For example, the DBMS may access a memory buffer, a reference or index a file for read, write, deletion, or any combination thereof, for responding to the statement. The DBMS may load the data from persistent or non-persistent storage and perform computations to respond to the query. The DBMS may return the result(s) to the user or software application.

The computing system of FIG. 5A may include functionality to present raw and/or processed data, such as results of comparisons and other processing. For example, presenting data may be accomplished through various presenting methods. Specifically, data may be presented through a user interface provided by a computing device. The user interface may include a GUI that displays information on a display device, such as a computer monitor or a touchscreen on a handheld computer device. The GUI may include various GUI widgets that organize what data is shown as well as how data is presented to a user. Furthermore, the GUI may present data directly to the user, e.g., data presented as actual data values through text, or rendered by the computing device into a visual representation of the data, such as through visualizing a data model.

For example, a GUI may first obtain a notification from a software application requesting that a particular data object be presented within the GUI. Next, the GUI may determine a data object type associated with the particular data object, e.g., by obtaining data from a data attribute within the data object that identifies the data object type. Then, the GUI may determine any rules designated for displaying that data object type, e.g., rules specified by a software framework for a data object class or according to any local parameters defined by the GUI for presenting that data object type. Finally, the GUI may obtain data values from the particular data object and render a visual representation of the data values within a display device according to the designated rules for that data object type.

Data may also be presented through various audio methods. In particular, data may be rendered into an audio format and presented as sound through one or more speakers operably connected to a computing device.

Data may also be presented to a user through haptic methods. For example, haptic methods may include vibrations or other physical signals generated by the computing system. For example, data may be presented to a user using a vibration generated by a handheld computer device with a predefined duration and intensity of the vibration to communicate the data.

The above description of functions presents only a few examples of functions performed by the computing system of FIG. 5A and the nodes and/or client device in FIG. 5B. Other functions may be performed using one or more embodiments of the disclosure.

While the disclosure has been described with respect to a limited number of embodiments, those skilled in the art, having benefit of this disclosure, will appreciate that other embodiments can be devised which do not depart from the scope of the disclosure as disclosed herein. Accordingly, the scope of the disclosure should be limited only by the attached claims.

What is claimed is:

1. A system, comprising:

a top drive coupled to a mast on a drilling rig;

a common bus coupled to the top drive;

a drawworks coupled to the common bus and the top drive, wherein the drawworks lowers and raises the top drive throughout the mast;

a generator coupled to the common bus, wherein the generator transmits electric power to the drawworks; and a controller coupled to the top drive, common bus, the generator, and the drawworks, wherein the common bus transmits the electric power between the top drive, drawworks, and the generator, wherein the controller manages a transmission of stored power in the top drive to the drawworks, and wherein the controller minimizes a peak power level of the generator and the drawworks during raising of the top drive.

2. The system of claim 1, wherein the common bus comprises a rectifier to convert DC power to generate DC and AC power for the drawworks.

3. The system of claim 1, wherein the controller comprises a sensor to measure an amount of the transmission of the stored power.

4. The system of claim 3, wherein the sensor further comprises telemetry to transmit data to the common bus.

5. The system of claim 1, wherein the top drive comprises a flywheel, wherein the stored power of the top drive is rotational energy generated using the flywheel.

6. The system of claim 5, wherein the rotational energy is collected when the top drive is being lowered.

7. A method, comprising:

obtaining, by a controller, power measurements regarding operation of a top drive;

determining, by the controller and using the power measurements, an amount of stored power in the top drive;

determining, by the controller and based on the amount of stored power, an amount of electric power from a generator for operating a drawworks; and transmitting, using the controller and over a common bus coupled to the top drive and a drawworks, the amount of electric power and at least a portion of the amount of stored power to the drawworks.

8. The method of claim 7, wherein the stored power in the top drive is generated from lowering the top drive down a mast of a rig with the drawworks and rotating the top drive to generate rotational energy and storing the rotational energy.

9. The method of claim 8, wherein transmitting the at least a portion of the amount of stored power comprises transferring the rotational energy from the top drive to a motor in the drawworks via the common bus.

10. The method of claim 9, further comprising accelerating, by the controller, a line of the drawworks to raise the top drive up the mast of the rig.

11. The method of claim 8, wherein during the lowering of the top drive, a portion of the stored energy is dissipated by brake resistors as heat.

12. The method of claim 7, wherein obtaining the power measurements comprises receiving data from a sensor device coupled to the top drive.

13. The method of claim 7, further comprising minimizing, by the controller, a peak power level of the generator during the raising of the top drive.

14. The method of claim 7, wherein the controller receives a selection of a peak power level from a user device, wherein the controller transmits at least one command to the generator or the top drive to implement the peak power level using the amount of electric power and the at least a portion of the amount of stored power.

15. A non-transitory computer readable medium storing instructions on a memory coupled to a processor, the instructions comprising functionality for:

obtaining power measurements regarding operation of a top drive;

determining, using the power measurements, an amount of stored power in the top drive;

determining, using the amount of stored power, an amount of electric power from a generator for operating a drawworks; and transmitting, over a common bus coupled to the top drive and a drawworks, the amount of electric power and a portion of the amount of stored power to the drawworks.

16. The non-transitory computer readable medium of claim 15, wherein the instructions further comprise functionality for:

receiving sensor data from a sensor device coupled to top drive, wherein the power measurements are determined using the sensor data.

17. The non-transitory computer readable medium of claim 15, wherein the instructions further comprise functionality for:

determining a power consumption sequence, wherein the power consumption sequence is a predetermined order defining different amounts of electric power for use by the top drive.

18. The non-transitory computer readable medium of claim 17, wherein the instructions further comprise functionality for:

minimizing a peak power level of the generator powering the drawworks.

19. The non-transitory computer readable medium of claim 15, wherein the instructions further comprise functionality for:

determining, during a lowering of the top drive, an amount of energy that is dissipated in the top drive by brake resistors as heat, wherein the amount of dissipated energy is from heat by brake resistors in the top drive.

* * * * *